US011480171B2

(12) United States Patent
Ren et al.

(10) Patent No.: US 11,480,171 B2
(45) Date of Patent: Oct. 25, 2022

(54) OIL PUMP AND SCROLL COMPRESSOR

(71) Applicant: Danfoss (Tianjin) Ltd., Tianjin (CN)

(72) Inventors: Liqian Ren, Tianjin (CN); Jian Jin, Tianjin (CN); Jing Zhao, Tianjin (CN); Yanbo Zhao, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 0 days.

(21) Appl. No.: 17/134,792

(22) Filed: Dec. 28, 2020

(65) Prior Publication Data

US 2021/0199112 A1 Jul. 1, 2021

(30) Foreign Application Priority Data

Dec. 31, 2019 (CN) ..... 201911422757.9

(51) Int. Cl.

| | |
|---|---|
| ***F04D 29/18*** | (2006.01) |
| ***F01D 1/18*** | (2006.01) |
| ***F01D 1/20*** | (2006.01) |
| ***F01D 1/24*** | (2006.01) |
| ***F01D 1/26*** | (2006.01) |
| ***F04C 2/02*** | (2006.01) |
| ***F04D 7/00*** | (2006.01) |

(52) U.S. Cl.

CPC ..... *F04C 2/025* (2013.01); *F04D 7/00* (2013.01); *F04C 2210/206* (2013.01); *F04C 2230/231* (2013.01); *F04C 2230/60* (2013.01); *F04C 2240/60* (2013.01)

(58) Field of Classification Search

CPC ..... F01D 1/18; F01D 1/20; F01D 1/24; F01D 1/26; F04D 29/181

See application file for complete search history.

(56) References Cited

U.S. PATENT DOCUMENTS

| | | | |
|---|---|---|---|
| 4,171,192 | A | 10/1979 | Taylor et al. |
| 4,331,420 | A | 5/1982 | Jones |
| 4,331,421 | A | 5/1982 | Jones et al. |

(Continued)

FOREIGN PATENT DOCUMENTS

| | | | |
|---|---|---|---|
| CN | 1074092 | C | 4/1997 |
| CN | 102116293 | A | 7/2011 |

(Continued)

OTHER PUBLICATIONS

First Examination Report for Indian Patent Application No. 202014054973 dated Jan. 13, 2022.

*Primary Examiner* — Deming Wan

(74) *Attorney, Agent, or Firm* — McCormick, Paulding & Huber PLLC

(57) ABSTRACT

The present invention provides a vertical, axial flow oil pump (10). The oil pump includes: a casing (11), the casing having a cylindrical shape as a whole and being able to rotate around its own central axis (O); a suction port (12), located at a lower end of the casing in an axial direction, and configured to suck oil into the oil pump; a discharge port (13), located at an upper end of the casing in the axial direction, and configured to discharge the oil from the oil pump to outside; and an impeller (14), provided in and formed integrally with the casing. The impeller rotates together with the casing when the casing rotates, so that the oil is flowed from the suction port to the discharge port. The present invention also provides a scroll compressor having the oil pump.

16 Claims, 7 Drawing Sheets

(56) References Cited

U.S. PATENT DOCUMENTS

| | | | | |
|---|---|---|---|---|
| 6,732,680 | B1 * | 5/2004 | Beltramo | F01P 5/10 415/209.1 |
| 8,624,418 | B2 * | 1/2014 | Deng | F03B 13/14 290/53 |
| 10,744,244 | B2 * | 8/2020 | Haddadi | A61M 60/422 |
| 2007/0160488 | A1 | 7/2007 | Yoo et al. | |
| 2011/0150690 | A1 * | 6/2011 | Tang | F04C 29/025 418/55.6 |
| 2012/0224970 | A1 * | 9/2012 | Schumacher | F04D 19/00 416/205 |
| 2012/0292907 | A1 * | 11/2012 | Krouse | F03B 17/066 290/52 |
| 2013/0039785 | A1 * | 2/2013 | Davidson | F04D 29/2261 417/410.1 |
| 2014/0044581 | A1 | 2/2014 | Mao et al. | |
| 2018/0243489 | A1 | 8/2018 | Haddadi | |

FOREIGN PATENT DOCUMENTS

| | | | |
|---|---|---|---|
| CN | 102655891 | A | 9/2012 |
| CN | 108087270 | A | 5/2018 |
| CN | 108138771 | A | 6/2018 |
| CN | 208416950 | U | 1/2019 |
| DE | 112006001283 | T5 | 4/2008 |
| EP | 2078162 | A1 | 7/2009 |
| KR | 10-0688656 | B1 | 3/2007 |
| KR | 10-2007-0056531 | A | 6/2007 |
| WO | 2008052297 | A1 | 5/2008 |

* cited by examiner

| | Examples of the present invention | | Comparative example | |
|---|---|---|---|---|
| Rotating Speed | EER | OCR | EER | OCR |
| 30 rps | 10.65 | 1.07 | 10.71 | 1.73 |
| 60 rps | 11.27 | 2.34 | 11.24 | 2.42 |
| 90 rps | 11.04 | 2.29 | 10.97 | 3.63 |

(a)

(b)

(c)

OIL PUMP AND SCROLL COMPRESSOR

CROSS-REFERENCE TO RELATED APPLICATION

This application claims foreign priority benefits under 35 U.S.C. § 119 to Chinese Patent Application No. 201911422757.9 filed on Dec. 31, 2019, the content of which is hereby incorporated by reference in its entirety.

BACKGROUND OF THE INVENTION

Technical Field

The present invention relates to an oil pump and a scroll compressor having the oil pump.

Background

In the existing variable speed scroll compressor, a gear oil pump is often used to supply oil or lubricant. In view of the inherent characteristics of this oil pump, a corresponding oil injection system is usually added to make up for the shortcomings of the oil pump. The oil pump and the oil injection system have the following disadvantages.

1) When the oil pump is running at a low speed, the oil supply is insufficient. Therefore, the oil injection system begins to participate in oil supply/injection to keep the oil circulation rate (OCR) at a normal level.

2) As the rotating speed of the oil pump increases, the OCR gradually increases. On the premise that the OCR is not lower than the normal level, the higher the OCR, the greater the input power of the oil circulation system, which means that the economy of the oil circulation system becomes worse.

3) The production cost of the oil injection system is high, and the assembly is difficult.

In order to overcome the above shortcomings, it is hoped to develop an oil pump which can provide a sufficiently high oil pressure at a low rotating speed so that no additional oil injection system is required, and which can provide relatively low the mass flow rate of the oil at a high rotating speed to improve the economy of the oil circulation system. In addition, it is hoped that the production cost and the use/maintenance cost of the oil pump are relatively low.

SUMMARY

The present invention provides a vertical axial-flow oil pump that meets the above requirements. The oil pump includes: a casing, the casing having a cylindrical shape as a whole and being able to rotate around its own central axis; a suction port, located at a lower end of the casing in an axial direction, and configured to suck oil into the oil pump; a discharge port, located at an upper end of the casing in the axial direction, and configured to discharge the oil from the oil pump to outside; and an impeller, provided in and formed integrally with the casing, wherein, the impeller rotates together with the casing when the casing rotates, so that the oil is flowed from the suction port to the discharge port.

The impeller includes a central body and a plurality of blades. The central body is located at a center of the impeller and has a cylindrical shape as a whole, and a central axis of the central body is collinear with the central axis of the casing. The plurality of blades are arranged at equal intervals on an outer circumference of the central body, and a surface of each blade is inclined with respect to the central axis of the casing.

A radial root of each blade is fixedly connected to the outer circumference of the central body, and a radial tip of the blade is fixedly connected to an inner wall of the casing.

Preferably, the number of the plurality of blades is two or more. The blade is a spiral blade or a flat blade. In the axial direction of the casing, the distance from the impeller to the suction port is smaller than the distance from the impeller to the discharge port.

Optionally, a plurality of grooves extending along the axial direction are provided on the outer circumferential surface of the casing.

In addition, the present invention provides a method for manufacturing the aforementioned oil pump, and the method includes: integrally manufacturing the casing and the impeller by means of a 3D printing method or an injection molding method.

In addition, the present invention provides a scroll compressor. The scroll compressor includes a fixed scroll, an orbiting scroll, and a drive shaft. The orbiting scroll and the fixed scroll are engaged with each other to form a compression chamber. The scroll compressor further includes the aforementioned oil pump. An upper end of the drive shaft is connected to the orbiting scroll, and a lower end of the drive shaft is connected to the oil pump. The oil supplied by the oil pump is transported to the orbiting scroll and the compression chamber through a channel provided inside the drive shaft.

An oil pool for recovering and storing oil is formed at a lower part of the scroll compressor, and the suction port of the oil pump is immersed in the oil in the oil pool.

BRIEF DESCRIPTION OF THE DRAWINGS

In order to facilitate the understanding of the present invention, the present invention will be described in more detail below based on exemplary embodiments in conjunction with the accompanying drawings. The same or similar reference signs are used in the drawings to indicate the same or similar elements. It should be understood that the drawings are only schematic, and the sizes and proportions of components in the drawings are not necessarily accurate.

DETAILED DESCRIPTION

Figure 1:
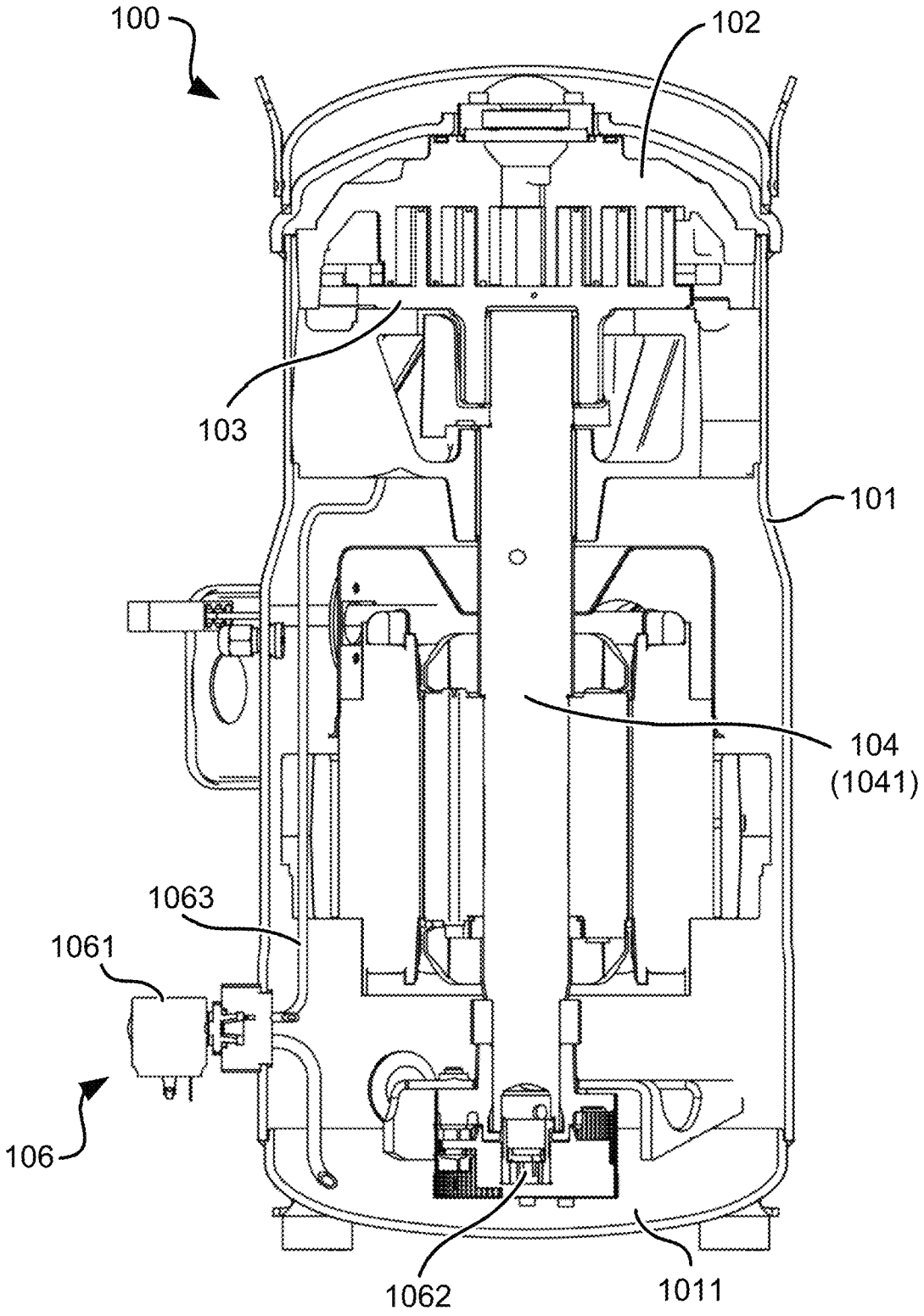
(Prior Art) FIG. 1
FIG. 1 is a schematic cross-sectional view of a prior art scroll compressor.

FIG. 1 is an exemplary cross-sectional view of a prior art scroll compressor 100. The scroll compressor 100 includes a housing 101, a fixed scroll 102, an orbiting scroll 103, a drive shaft 104, and an oil injection system 106. The orbiting scroll 103 and the fixed scroll 102 are engaged with each other to form a compression chamber. An oil pool 1011 is formed in the lower part of the compressor 100. The oil injection system 106 includes an oil supply and return device 1061, a gear oil pump 1062, an oil injection pipe 1063, and the like. The oil from the outside is divided into two paths through the oil supply and return device 1061: the oil in one path is supplied to the oil pump 1062, and the oil in the other path is supplied along the injection pipe 1063 to the compression chamber for injection.

As shown in FIG. 1, the upper end of the drive shaft 104 is connected to the orbiting scroll 103. The lower end of the drive shaft 104 is connected to the oil pump 1062. The oil supplied by the oil pump 1062 is transported to the orbiting scroll 103 and the compression chamber through the channel 1041 provided inside the drive shaft 104.

Figure 2:
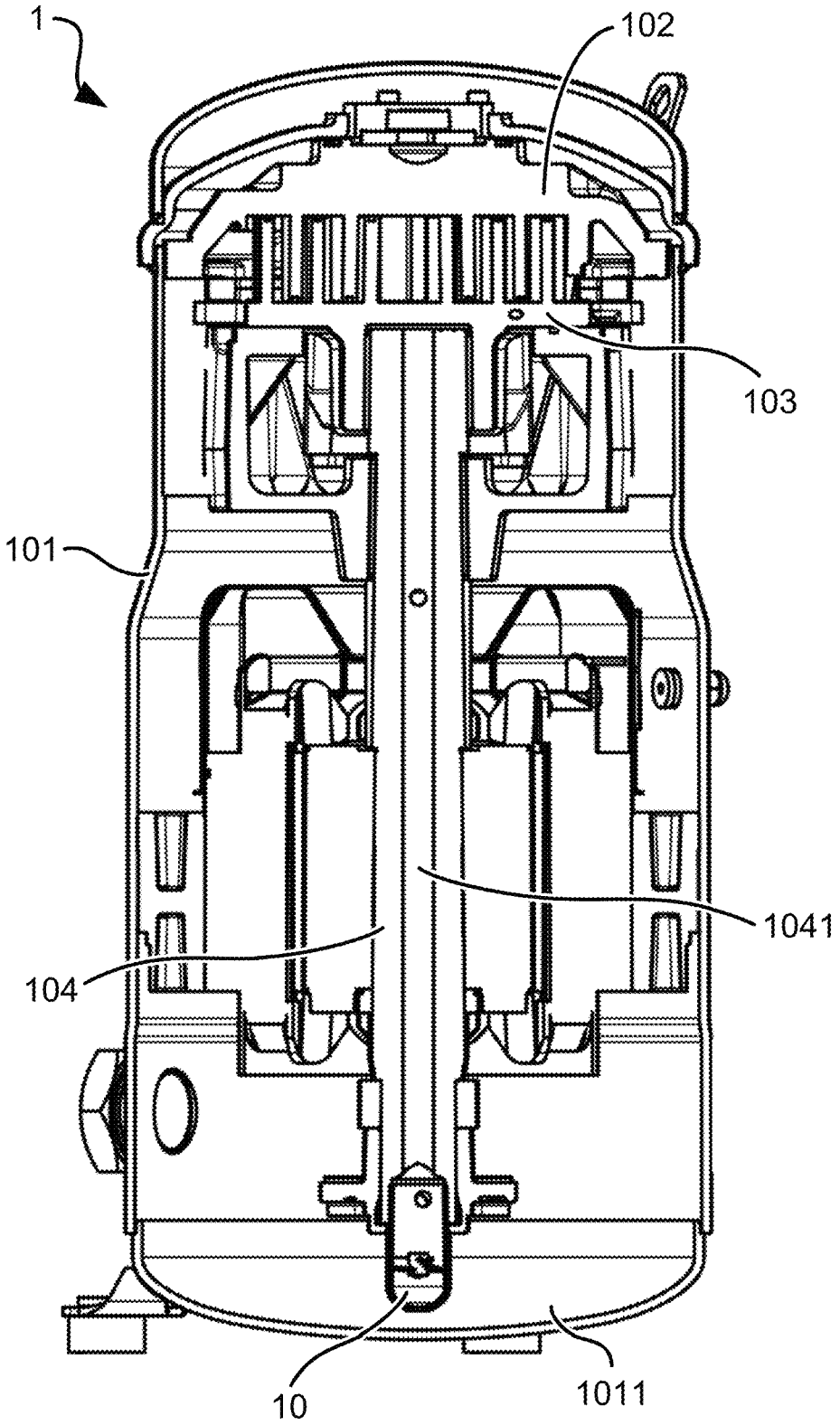
FIG. 2 is a schematic cross-sectional view of a scroll compressor according to an embodiment of the present invention.

FIG. 2 is a schematic cross-sectional view of a scroll compressor 1 according to an embodiment of the present invention. As shown in FIG. 2, a lower end of a drive shaft 104 is connected to an oil pump 10. The oil supplied by the oil pump 10 is transported to an orbiting scroll 103 and a compression chamber through a channel 1041 provided inside the drive shaft 104. An oil pool 1011 for recovering and storing oil is formed in a lower part of the scroll compressor 1. A suction port of the oil pump 10 is immersed into the oil in the oil pool 1011.

The scroll compressor 1 according to the embodiment of the present invention shown in FIG. 2 differs from the prior art scroll compressor 100 shown in FIG. 1 in that the oil pump 10 of the scroll compressor 1 shown in FIG. 2 is a vertical, axial flow oil pump, and the oil injection system 106 is omitted/canceled.

Figure 3:
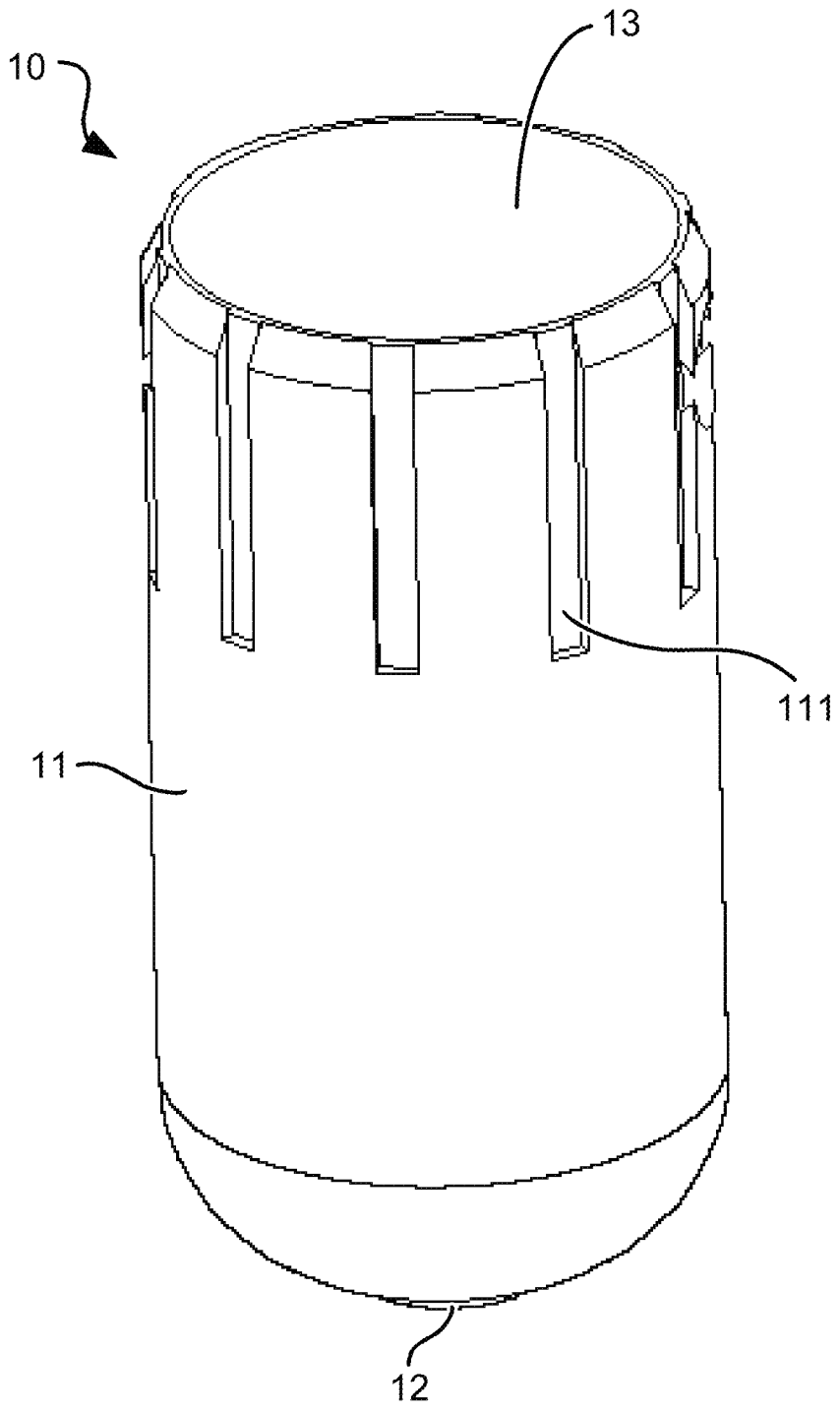
FIG. 3 is a schematic perspective view of an oil pump according to an embodiment of the present invention.
Figure 4:
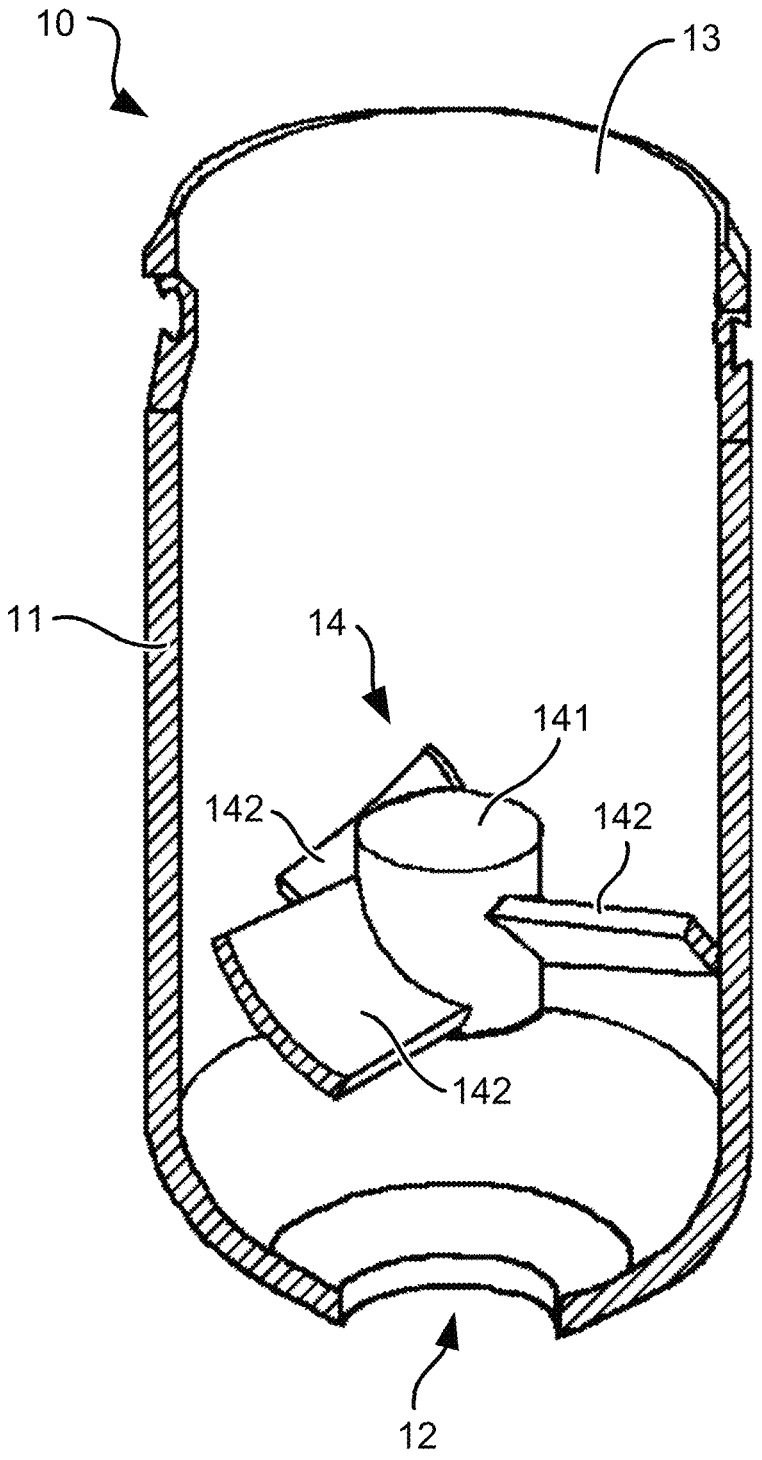
FIGS. 4, 5 and 6 are schematic cross-sectional views of the oil pump shown in FIG. 3, with a rotating direction of the oil pump and a flow direction of the oil shown in FIG. 5, and a schematic size of the oil pump shown in FIG. 6.
Figure 5:
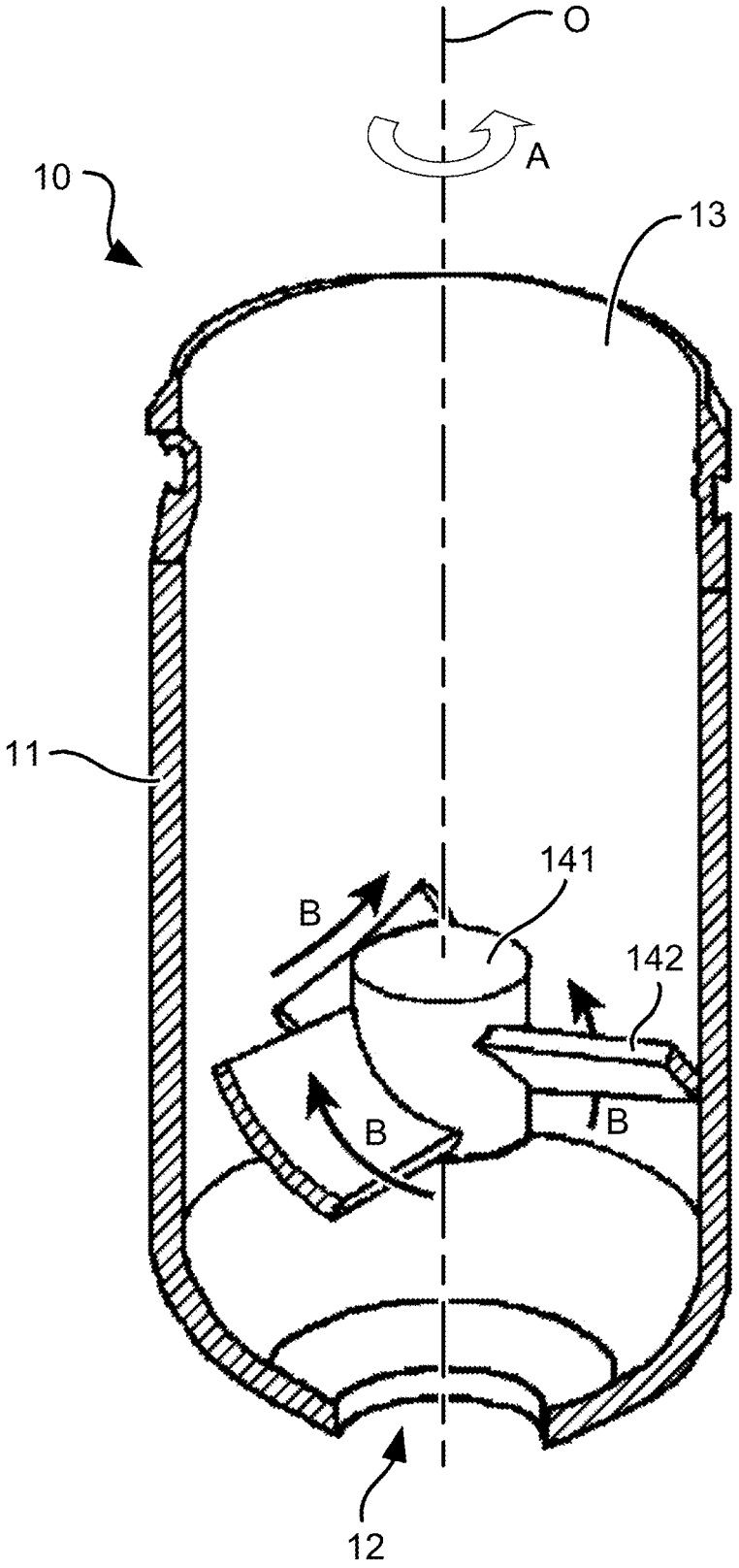
Figure 6:
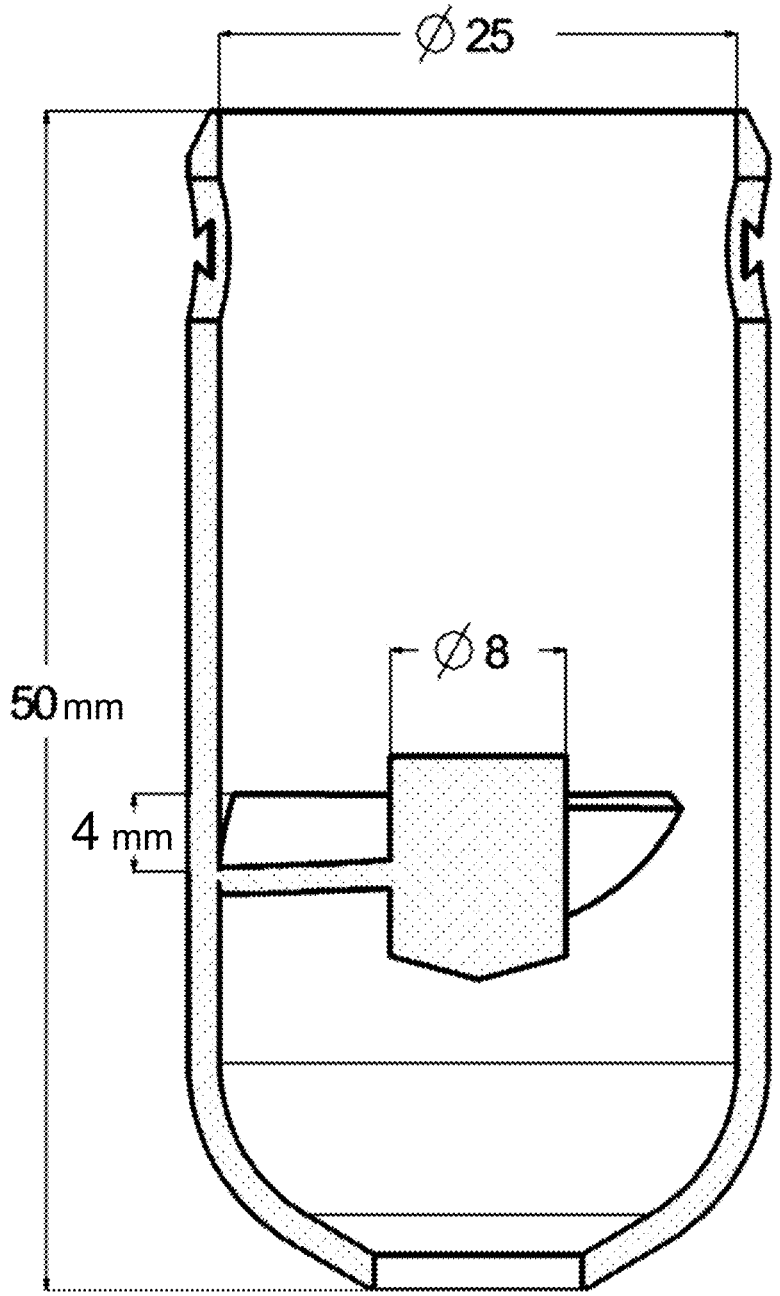

FIG. 3 is a schematic perspective view of an oil pump 10 according to an embodiment of the present invention. FIGS. 4, 5 and 6 are schematic cross-sectional views of the oil pump 10 shown in FIG. 3, with a rotating direction of the oil pump 10 and a flow direction of the oil shown in FIG. 5, and a schematic size of the oil pump 10 shown in FIG. 6.

As shown in FIGS. 3 to 6, the oil pump 10 includes: a casing 11, which has a cylindrical shape as a whole and is able to rotate around its own central axis O; a suction port 12, which is located at a lower end of the casing 11 in an axial direction and is configured to suck oil into the oil pump 10; a discharge port 13, which is located at an upper end of the casing 11 in the axial direction, and is configured to discharge the oil from the oil pump 10 to outside; and an impeller 14, which is provided in the casing 11 and is formed integrally with the casing 11. When the casing 11 rotates, the impeller 14 rotates together with the casing 11 so that the oil is flowed from the suction port 12 to the discharge port 13. The discharge port 13 is in communication with the channel 1041 inside the drive shaft 104.

As shown in FIG. 3, a plurality of grooves 111 extending along the axial direction may be provided on the outer circumferential surface of the casing 11. Corresponding internal teeth (not shown) of the drive shaft 104 are fitted in the grooves 111, so that the oil pump is coupled to the drive shaft 104.

As shown in FIG. 4, the impeller 14 includes a central body 141 and a plurality of blades 142. The number of the plurality of blades may be two, three or more. The blade 142 may be a spiral blade or a flat blade. The central body 141 is located at the center of the impeller 14 and has a cylindrical shape as a whole.

As shown in FIG. 5, a central axis of the central body 141 and the central axis O of the casing 11 are collinear. The plurality of blades 142 are arranged at equal intervals on the outer circumference of the central body 141, and the surface of each blade is inclined with respect to the central axis O, thereby ensuring that the impeller 14 has the ability to push oil. The radial root of the blade 142 is fixedly connected to the outer circumference of the central body 141, and the radial tip of the blade 142 is fixedly connected to the inner wall of the casing 11. For example, the casing 11 and the impeller 14 may be integrally manufactured by means of a 3D printing method or an injection molding method. In addition, the casing 11 and the impeller 14 may be formed separately in advance, and then the impeller 14 and the casing 11 may be integrated by other methods, such as welding, bonding, riveting, etc.

As shown in FIG. 5, when the casing 11 rotates in the direction indicated by the arrow A, the oil enters the casing 11 from the suction port 12, and then is pushed upward by the upper surface of the blade 142 in the direction indicated by the arrow B, thereby generally flowing towards the discharge port 13.

As shown in FIG. 6, the length of the casing 11 is 50 mm and the inner diameter of the casing 11 is 25 mm; the diameter of the central body 141 of the impeller 14 is 8 mm, and the vertical height of the blade 142 is 4 mm. In addition, in the axial direction of the casing 11, the distance from the impeller 14 to the suction port 12 may be smaller than the distance from the impeller 14 to the discharge port 13.

Figure 7:
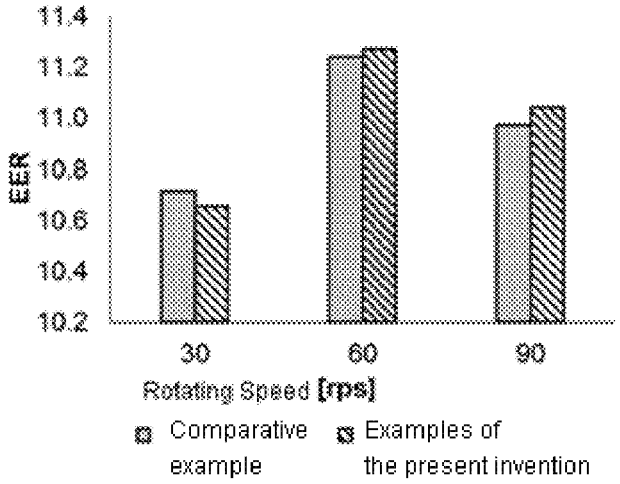
FIG. 7 shows a comparison result of related technical indicators of the scroll compressor according to the embodiment of the present invention and an existing scroll compressor.
Figure 7:
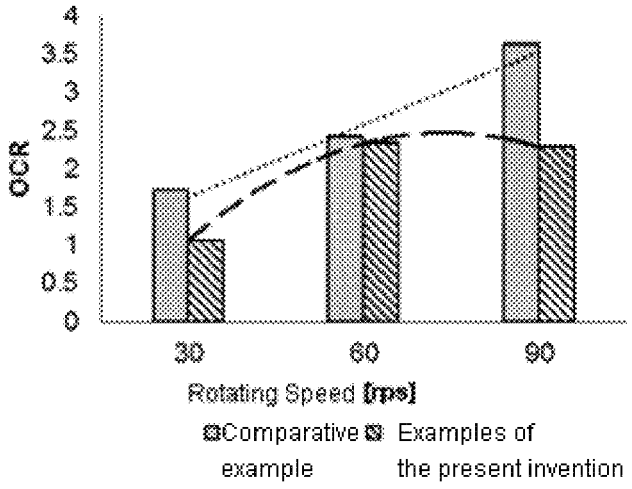

FIG. 7 shows a comparison result of related technical indicators of the scroll compressor according to the embodiment of the present invention and an existing scroll compressor. Specifically, FIG. 7(*a*) shows the comparison result of the related technical indicators of the scroll compressor 1 and the existing scroll compressor in the form of a table. These technical indicators include the EER (energy efficiency ratio for refrigeration) and the OCR. FIG. 7(*b*) and FIG. 7(*c*) show the above comparison results in the form of a more intuitive histogram based on the data in the table in FIG. 7(*a*).

It can be seen that the EER of the scroll compressor 1 according to the embodiment of the present invention is substantially the same as the EER of the existing scroll compressor, and they both comply with relevant regulations. In terms of the OCR, the scroll compressor 1 according to the embodiment of the present invention is generally better than the existing scroll compressor. Therefore, the scroll compressor 1 according to the embodiment of the present invention is more economical during operation.

In addition, the oil injection system is omitted from the scroll compressor 1 according to the embodiment of the present invention, and the structure of the vertical, axial flow oil pump 10 is simpler than that of a conventional gear oil pump. Therefore, compared with the existing scroll compressor with the gear oil pump and the oil injection system, the production cost of the scroll compressor 1 according to the embodiment of the present invention is significantly reduced. In some cases, a 52.4% decline in production cost can be achieved. In addition, the usage cost and the maintenance cost of the scroll compressor 1 according to the embodiment of the present invention are also lower.

The technical objects, technical solutions and technical effects of the present invention are described in detail above with reference to specific embodiments. It should be understood that the abovementioned embodiments are only illustrative and not restrictive. Within the spirit and principle of the present invention, any modifications, equivalent substitutions, improvements, etc. made by those skilled in the art are all included in the protection scope of the present invention.

What is claimed is:

1. An oil pump, comprising:

a casing, the casing having a cylindrical shape as a whole and being rotatable around its own central axis;

a suction port, located at a lower end of the casing in an axial direction, and configured to suck oil into the oil pump;

a discharge port, located at an upper end of the casing in the axial direction, and configured to discharge the oil from the oil pump to outside;

an impeller, provided in and formed integrally with the casing, wherein, the impeller rotates together with the casing when the casing rotates, so that the oil is flowed from the suction port to the discharge port; and a plurality of grooves provided on the outer circumferential surface of the casing and extending along the axial direction.

2. The oil pump according to claim 1, wherein the impeller comprises:

a central body, located at a center of the impeller and having a cylindrical shape as a whole, a central axis of the central body being collinear with the central axis of the casing; and a plurality of blades, arranged at equal intervals on an outer circumference of the central body, and a surface of each blade being inclined with respect to the central axis of the casing.

3. The oil pump according to claim 2, wherein a radial root of each of the blades is fixedly connected to the outer circumference of the central body, and a radial tip of the blade is fixedly connected to an inner wall of the casing.

4. The oil pump according to claim 3, wherein the number of the plurality of blades is two or more.

5. A method for manufacturing the oil pump according to claim 4, the method comprising:

integrally manufacturing the casing and the impeller by means of a 3D printing method or an injection molding method, or separately manufacturing the casing and the blade, and then assembling the casing and the impeller into an integrated structure by means of bonding, riveting or welding.

6. The oil pump according to claim 3, wherein the blade is a spiral blade or a flat blade.

7. A method for manufacturing the oil pump according to claim 6, the method comprising:

integrally manufacturing the casing and the impeller by means of a 3D printing method or an injection molding method, or separately manufacturing the casing and the blade, and then assembling the casing and the impeller into an integrated structure by means of bonding, riveting or welding.

8. A scroll compressor, comprising:

a fixed scroll;

an orbiting scroll, the orbiting scroll and the fixed scroll being engaged with each other to form a compression chamber; and a drive shaft, wherein the scroll compressor further comprises the oil pump according to claim 3, and wherein, an upper end of the drive shaft is connected to the orbiting scroll, a lower end of the drive shaft is connected to the oil pump, and the oil supplied by the oil pump is transported to the orbiting scroll and the compression chamber through a channel provided inside the drive shaft.

9. The oil pump according to claim 2, wherein the number of the plurality of blades is two or more.

10. The oil pump according to claim 2, wherein the blade is a spiral blade or a flat blade.

11. A method for manufacturing the oil pump according to claim 2, the method comprising:

integrally manufacturing the casing and the impeller by means of a 3D printing method or an injection molding method, or separately manufacturing the casing and the blade, and then assembling the casing and the impeller into an integrated structure by means of bonding, riveting or welding.

12. A method for manufacturing the oil pump according to claim 3, the method comprising:

integrally manufacturing the casing and the impeller by means of a 3D printing method or an injection molding method, or separately manufacturing the casing and the blade, and then assembling the casing and the impeller into an integrated structure by means of bonding, riveting or welding.

13. A scroll compressor, comprising:

a fixed scroll;

an orbiting scroll, the orbiting scroll and the fixed scroll being engaged with each other to form a compression chamber; and a drive shaft, wherein the scroll compressor further comprises the oil pump according to claim 2, and wherein, an upper end of the drive shaft is connected to the orbiting scroll, a lower end of the drive shaft is connected to the oil pump, and the oil supplied by the oil pump is transported to the orbiting scroll and the compression chamber through a channel provided inside the drive shaft.

14. A method for manufacturing the oil pump according to claim 1, the method comprising:

integrally manufacturing the casing and the impeller by means of a 3D printing method or an injection molding method, or separately manufacturing the casing and the blade, and then assembling the casing and the impeller into an integrated structure by means of bonding, riveting or welding.

15. A scroll compressor comprising:

a fixed scroll;

an orbiting scroll, the orbiting scroll and the fixed scroll being engaged with each other to form a compression chamber; and a drive shaft, wherein the scroll compressor further comprises the oil pump according to claim 1, and wherein, an upper end of the drive shaft is connected to the orbiting scroll, a lower end of the drive shaft is connected to the oil pump, and the oil supplied by the oil pump is transported to the orbiting scroll and the compression chamber through a channel provided inside the drive shaft.

16. The scroll compressor according to claim 15, wherein an oil pool for recovering and storing oil is formed at a lower part of the scroll compressor, and the suction port of the oil pump is immersed into the oil in the oil pool.

* * * * *